US007895786B2

(12) United States Patent
Caulley

(10) Patent No.: US 7,895,786 B2
(45) Date of Patent: Mar. 1, 2011

(54) ADAPTABLE FIRING PIN ASSEMBLY FOR A BOLT ACTION FIREARM

(76) Inventor: Bruce Caulley, Albany Creek (AU)

( * ) Notice: Subject to any disclaimer, the term of this patent is extended or adjusted under 35 U.S.C. 154(b) by 18 days.

(21) Appl. No.: 11/658,824

(22) PCT Filed: Jul. 28, 2005

(86) PCT No.: PCT/AU2005/001110

§ 371 (c)(1),
(2), (4) Date: Sep. 9, 2008

(87) PCT Pub. No.: WO2006/010215

PCT Pub. Date: Feb. 2, 2006

(65) Prior Publication Data

US 2009/0049730 A1 Feb. 26, 2009

(30) Foreign Application Priority Data

Jul. 28, 2004 (AU) ..... 2004904202

(51) Int. Cl.
*F41A 3/12* (2006.01)

(52) U.S. Cl. ..... 42/69.02

(58) Field of Classification Search ..... 42/69.02, 42/69.01, 14, 1.42, 187.02, 188
See application file for complete search history.

(56) References Cited

U.S. PATENT DOCUMENTS 207,056 A * 8/1878 Mesle ..... 42/16
1,693,530 A * 11/1928 Spencer ..... 42/16
3,631,620 A * 1/1972 Ohira ..... 42/16
3,696,542 A * 10/1972 Ekfeldt et al. ..... 42/16
3,745,686 A * 7/1973 Koon, Jr. ..... 42/16
3,849,925 A * 11/1974 Mayer ..... 42/75.02

(Continued)

FOREIGN PATENT DOCUMENTS

DE 145972 1/1903

(Continued)

OTHER PUBLICATIONS

Search Report for PCT Application PCT/AU2005/001110 mailed Oct. 19, 2005.

(Continued)

*Primary Examiner*—Bret Hayes
*Assistant Examiner*—Reginald Tillman, Jr.
(74) *Attorney, Agent, or Firm*—Meyertons, Hood, Kivlin, Kowert & Goetzel, P.C.; Eric B. Meyertons

(57) ABSTRACT

Assembly (39) for a bolt action firearm comprises impact member (43) for impacting firing pin (42), spring (44) and shroud (45) for housing both member (43) and spring (44). Shroud (45) connects to the proximal end of bolt (40) which houses firing pin (42) and firing pin return spring (41). When assembly (39) is in a firing mode, a firing mechanism controls the release of energy stored in spring (44) so that member (43) impacts on the proximal end of firing pin (42) which then fires a cartridge located within a firing chamber in a known manner. Firing pin (42) may be located in a concentric position relative to the axis of bolt (40) for firing centre fire cartridges, or the axis of firing pin (42) may be offset to suit rim fire cartridges.

14 Claims, 18 Drawing Sheets

U.S. PATENT DOCUMENTS

| | | | | | |
|---|---|---|---|---|---|
| 4,126,079 | A | | 11/1978 | Perrine | |
| 4,402,152 | A | * | 9/1983 | Casull | 42/16 |
| 4,679,487 | A | | 7/1987 | Houseman | |
| 4,930,238 | A | * | 6/1990 | Poff, Jr. | 42/16 |
| 5,722,194 | A | * | 3/1998 | Wurger et al. | 42/69.02 |
| 6,061,944 | A | * | 5/2000 | Schroeder | 42/16 |

FOREIGN PATENT DOCUMENTS

| | | |
|---|---|---|
| EP | 0 036 853 | 3/1981 |
| FR | 983846 | 6/1951 |
| GB | 02401 | 2/1911 |

OTHER PUBLICATIONS

Written Opinion for PCT Application PCT/AU2005/001110 mailed Oct. 19, 2005.

International Preliminary Examination Report for PCT Application PCT/AU2005/001110 mailed Jun. 22, 2006.

European Supplementary Search Report and Examination Report issued Oct. 4, 2010 for European Application No. 05764163.

* cited by examiner

ADAPTABLE FIRING PIN ASSEMBLY FOR A BOLT ACTION FIREARM

FIELD OF THE INVENTION

The present invention relates to firearms such as rim fire and centre fire rifles. It is particularly relevant to bolt action rifles having a receiver for receipt of a bolt assembly.

BACKGROUND OF THE INVENTION

A typical bolt action firearm consists of a receiver mounted in a stock of the firearm and bolt slidably received within an elongate chamber of the receiver.

By using a bolt handle which is typically provided on a collar piece, the bolt is able to slide between a receiver open position where a cartridge may be inserted into the receiver and a closed position where the bolt is locked in position, thereby restraining the cartridge into a firing chamber.

Typically, cartridges may be divided into two categories: centre fire, or rim fire. Centre fire cartridges have the ignition means located concentric to the bore axis and at the rear end of the cartridge. Rim fire cartridges contain the ignition means within the outer rear rim of the cartridge.

Typically the system for firing a centre fire cartridge in a bolt action firearm consists of a firing pin which is locatable in a central passage within a bolt which is able to rotate around the same axis as the bore of the barrel. Locking this bolt into the closed position is typically achieved by having protruding lugs at some distance along the rotatable bolt body engaging matching recesses within the receiver, or alternatively, matching recesses within the barrel.

The firing pin is typically assembled within the bolt body with a spring, which is typically mounted around the external surface of the firing pin. This main spring is typically restrained between a flanged face of the firing pin and the front face of the shroud.

By operating a firing mechanism the spring is able to force the firing pin to impact on the ignition means of the cartridge within the firing chamber.

Typically, the firing system for firing a rim fire cartridge in a bolt-action firearm consists of a bolt body that for part of its length is semi-circular in cross section. This bolt body typically does not rotate within the receiver. A rotating collar attached to this bolt body typically has mounted on it the means for locking the bolt assembly into the receiver. Typically, a firing pin is housed within the non-rotating bolt body, with the point/axis of impact directed at the rim of the cartridge within the firing chamber. Typically, this firing pin is acted upon by a spring also housed within the bolt body. By operating a firing mechanism the spring is able to force the firing pin to impact on the ignition means of the cartridge within the firing chamber.

By operating a firing mechanism the spring is able to force the firing pin to impact on the ignition mass of the cartridge within the firing chamber.

Typically centre fire and rim fire firearms have different designs and therefore components, which are differently designed. The design of a rim fire bolt action firearm is typically more complicated than that of the centre fire bolt action firearm because of the necessity of having offset centre striking of the cartridge by the firing pin.

Because rim fire and centre fire firearms require different components there is no easy way of modifying one type of firearm to allow it to fire cartridges of the other type. In other types of rifle and handgun actions, such as lever, pump, self-loading and revolving, the difference between rim and centre fire actions is typically little more than the location of the firing pin/impact member.

Preferably the present invention is aimed at allowing an assembly to be made for either rim or centre fire cartridges, the only potential difference between an example of each being the position of the impact member or firing pin relative to the bore axis of the firearm.

The present invention is aimed at providing a different assembly of components which can be used in a rim fire or centre fire firearm without major differences in the design of components to be used for either type.

Thus it is desired that an assembly in accordance with the present invention can be used in combination with existing firearm components with minor modifications if necessary for firing either rim fire or centre fire cartridges.

Typically the firing system for firing a cartridge consists of a striker with a firing pin which is locatable in a central passage through the bolt. The striker is typically provided with a spring which is either mounted around the external surface of the striker or is located directly behind the striker mounted on a spring support.

By operating a firing mechanism the striker spring is able to force the firing pin of the striker to impact on the cartridge within the firing chamber. Many firearms and in particular rifles are typically divided into rim fire and centre fire actions.

In a rim fire firearm, rim fire cartridges are used as a cheap way of providing powder, projectile and ignition source in one package. The rim of the cartridge is formed by folding the base of the cartridge to form a rim which contains a priming compound. The rim is struck by a firing pin which is off centre from the centre of the bolt. In contrast centre fire firearms have a centrally located firing pin which is designed to strike the centre of the rear of a cartridge. Typically the centre fire firearm is a more accurate firearm but the cartridges are more expensive. Hence both types of firearms are in common use.

Typically centre fire and rim fire firearms have different designs and therefore components which are differently designed. The design of a rim fire firearm is typically more complicated than that of the centre fire firearm because of the offset centre striking of the cartridge by the striker pin.

Because rim fire and centre fire firearms require different components there is no easy way of modifying one type of firearm to allow it to fire cartridges of the other type.

The present invention is aimed at providing a different assembly of components which can be used in a rim fire or centre fire firearm without major differences in the design of components to be used for either type. Thus it is desired that an assembly in accordance with the present invention can be used in combination with existing firearm components with minor modifications if necessary for firing either rim fire or centre fire cartridges.

SUMMARY OF THE INVENTION

In accordance with one aspect of the present invention there is provided an assembly for a bolt action firearm comprising an impact member for impacting on a firing pin, a spring means and a housing for housing the impact member and spring means, wherein the impact member is configured to be located in the housing with the spring means behind the proximal end of a bolt having a firing pin and is able to be controlled by a firing mechanism to strike the firing pin proximal end when in a firing mode by release of energy stored by the spring means.

According to one embodiment of the present invention, the impact member is hinged within the housing and configured to use energy stored within the spring means to rotate the impact member into contact with the proximal end of the firing pin.

According to another aspect of the present invention there is provided a cocking piece having a distal end for striking a firing pin and having at least one lateral portion for retaining one end of a spring.

According to another aspect of the present invention there is provided an assembly for a bolt action firearm comprising an impact member for impacting a striker pin, a spring means and a bolt having a firing pin proximal end located in the proximal end of the bolt whereby the impact member is located behind the proximal end of the bolt and is able to be controlled to strike the firing pin proximal end when a firing mechanism is operated in a firing mode to release energy stored in the spring means.

The spring means preferably comprises at least one spring which may be a compression or extension spring.

Preferably the spring means is located behind the proximal end of the bolt.

Preferably the firing pin proximal end protrudes proud of the proximal end of the bolt when in the firing mode.

The impact member preferably comprises an elongate member with a collar at a distal end thereof.

The impact member is preferably configured to receive a spring of the spring means over an elongate portion.

Preferably the collar has a generally flat distal end surface which is configured to strike the head of the striker pin.

It is preferred that the striker pin fits within an elongate channel of the bolt.

The collar preferably comprises a cylindrical enlarged portion at the distal end of the impact member.

The collar and elongate portion are preferably concentrically arranged about a central longitudinal axis of the assembly.

According to another embodiment of the invention the impact member comprises a central bore which is adapted to receive at least part of the spring means.

Preferably a spring of the spring means fits into the bore of the impact member.

Preferably the outer peripheral surface of the impact member contacts the inner peripheral surface of the housing.

It is preferred that the housing includes a distal inner peripheral threaded portion which is adapted to receive a threaded portion of the bolt.

The assembly may include a housing for coaxially aligning the impact member and the bolt.

The firing pin may be centrally located in a bolt or offset from the centre of the bolt.

The bolt body may accommodate multiple firing pins.

The firing pin may incorporate a striker.

Preferably the housing includes a detachable shroud located over the proximal end of the bolt.

The bolt proximal end may comprise an enlarged portion having a greater diameter than the main body of the bolt.

Preferably the enlarged portion comprises a substantially cylindrical collar.

The shroud may have guidance portions for receiving pins on which the striker piece is able to slide.

The impact member may or may not protrude from the rear or distal end of the shroud.

Preferably the impact member includes a retainer means for retaining the spring means.

The retainer means may comprise lateral portions extending from a main body portion of the impact member.

The retainer means may comprise a flange of greater size than the main body of the impact member.

The retainer means may comprise rebated or counter bored recesses in a face of the impact member.

The main body may comprise a cylindrical rod.

The lateral portions may comprise a pair of left and right side lugs.

Preferably the left and right side lugs include holes adapted to align the impact member to slide on the pins.

According to one embodiment there is provided a single collar.

The spring means may comprise a central spring or a plurality of lateral springs.

It is preferred that two springs are located behind the lateral portions and rest against a rear wall of the housing.

The housing may include lateral channels for receipt of springs.

The housing may include a central channel for receipt of the impact member.

The lateral portions may be located at the distal end of the impact member.

The impact member preferably comprises a cocking piece.

The housing may comprise a seat for the impact member and spring means.

The housing may include a provision for a safety mechanism.

The housing may include a seating arrangement for a shroud.

Preferably the housing is formed from detachable upper and lower parts.

The impact member may have a sear or spigot for engagement by a clip when the bolt is pulled back.

According to an alternative embodiment the impact member comprises an annular hole in a distal end thereof for receiving one end of the spring means.

The bolt body may be formed from separate parts.

The housing may include a window for a cam surface.

The cam surface preferably co acts with the sear.

It is preferred that the firing pin is moveable with the bolt.

Preferably the firing pin returns to the firing mode by action the bolt body being closed upon a cartridge in the firing chamber.

Alternatively the firing pin returns to the firing mode proud of the proximal end of the bolt by action of a compression spring.

According to another embodiment of the invention the pin includes a detent which is able to be engaged by a cam surface of a sleeve member riding on the bolt.

According to one embodiment the bolt proximal end has a peripheral thread which is configured to screw into a distal end of the housing.

According to another embodiment the proximal end of the bolt includes a protrusion configured to act as a cam to force the impact member to compress a main spring of the spring means against a proximal inner wall of the housing.

According to another embodiment of the present invention the impact member comprises a lateral pin which is configured to contact a cam portion of the bolt.

According to one embodiment the cam portion is removably connectable to the bolt.

According to a further embodiment of the present invention the impact member comprises an elongate member with a centrally located collar portion.

It is preferred that the lateral pin is located on a distal side of the collar.

It is preferred that rotation of the cam surface allows the cam surface to act upon the pin to force the spring to be compressed between the collar and an inner surface of the housing.

According to one embodiment the proximal end of the bolt has one or more pins/protrusions for engaging with a cam surface on the distal end of the impact member to permit cocking of the impact member, while the bolt body is being moved out of the cocked position. The reverse configuration is also possible.

Preferably for this action of the cam surface to take place, the impact member must be prevented from rotating relative to the bolt body.

BRIEF DESCRIPTION OF THE DRAWINGS

A preferred embodiment of the present invention will now be described by way of example only with reference to the accompanying drawings in which.

DETAILED DESCRIPTION OF THE DRAWINGS

Figure 1:
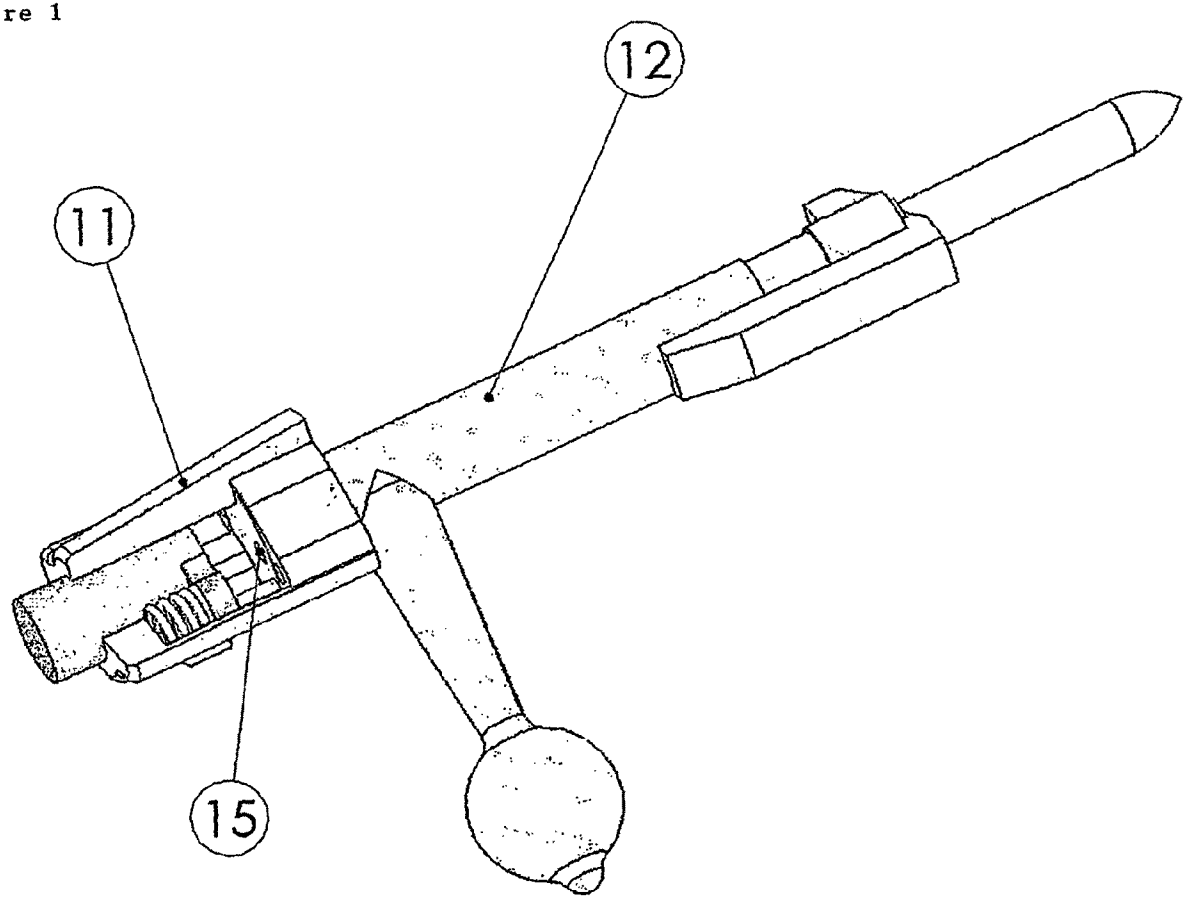
FIG. 1 shows a perspective view of a striker assembly according to a preferred embodiment of the present invention.
Figure 2:
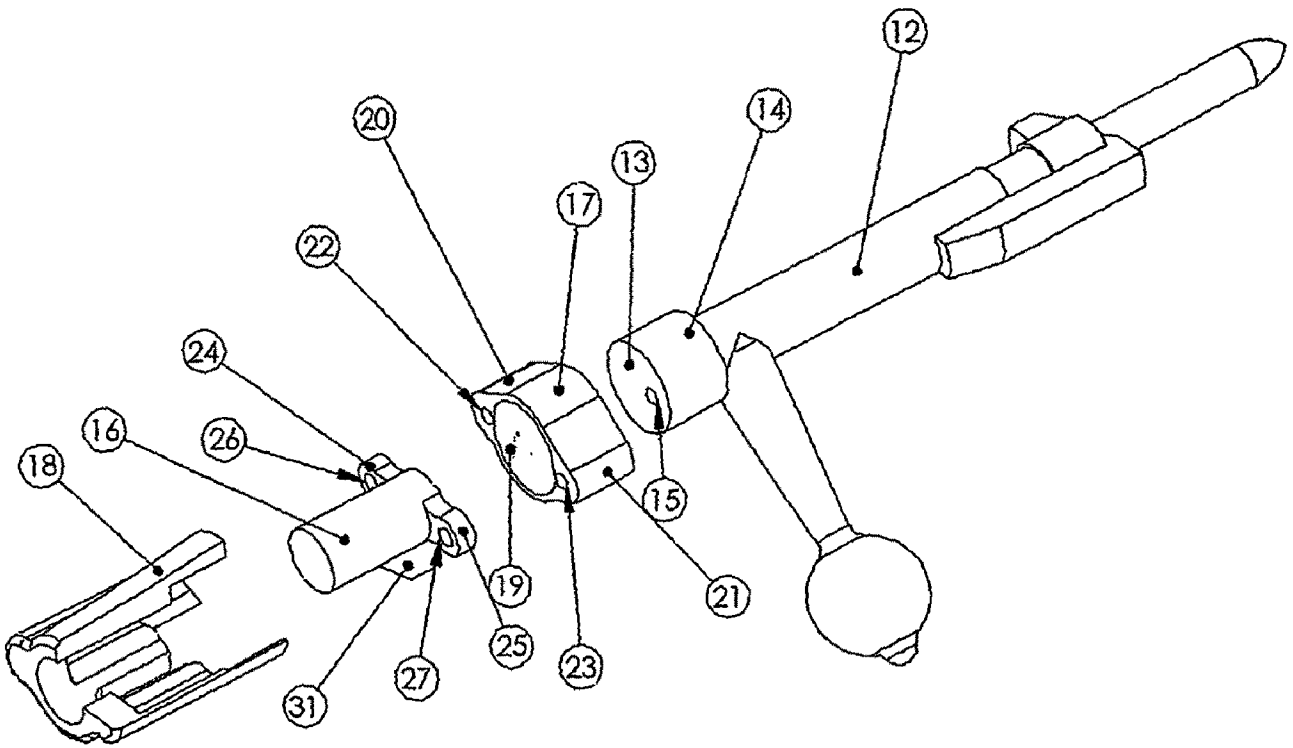
FIG. 2 shows a disassembled perspective view of the striker assembly shown in FIG. 1.

As shown in FIG. 1 the striker assembly 11 is positioned behind the bolt 12. The bolt 12 is modified as shown in FIG. 2 and is provided with a small off centre axial bore (rim fire—version) sized to receive a long thin firing pin (shown more clearly in FIG. 6). Referring to FIG. 2, the bottom, rear or proximal end 13 of the bolt 12 has an enlarged cylindrical section 14 and an opening 15 for the firing pin can be seen in the flat proximal face of the enlarged section 14.

The striker assembly 11 consists of a striker or cocking piece 16, a shroud insert 17 and housing 18. A spring (not shown) is also part of the striker assembly.

Figure 3:
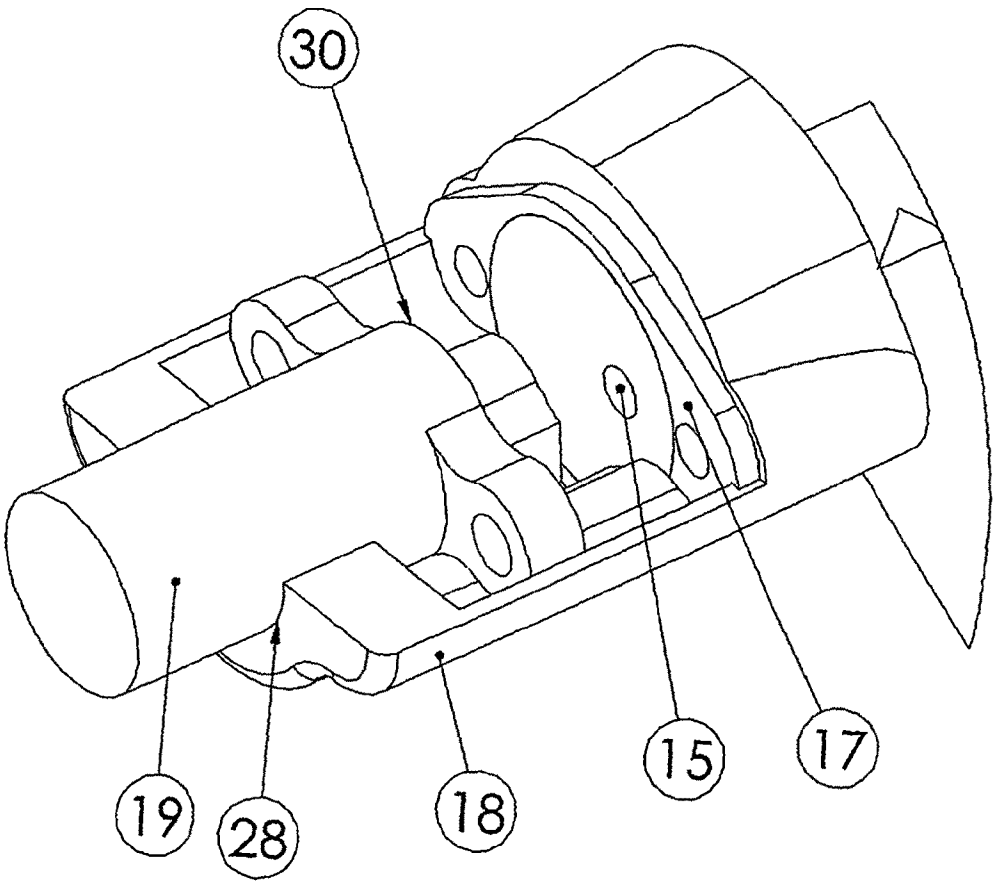
FIG. 3 shows a perspective view of an assembled striker assembly with a top cover of the housing of the assembly removed.
Figure 4:
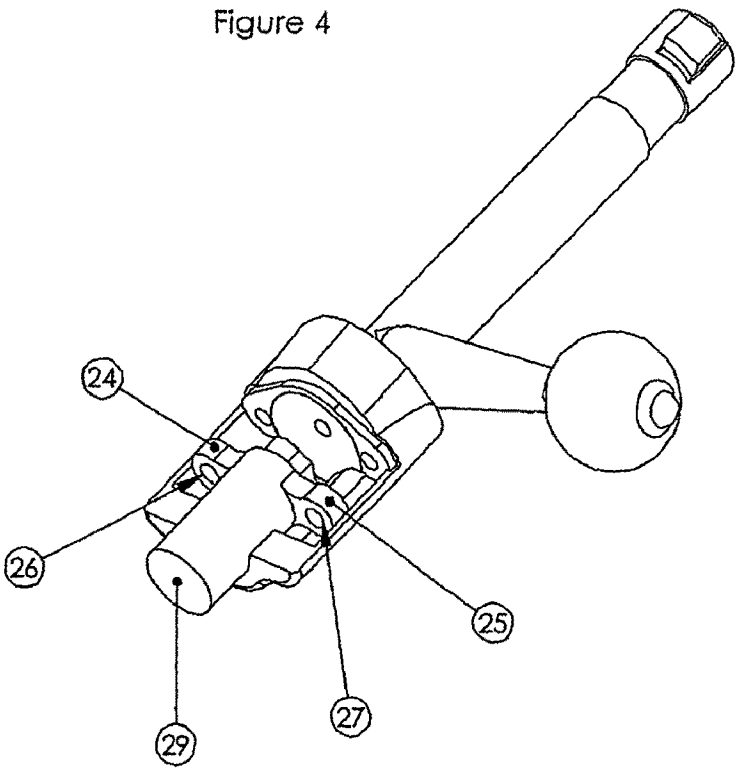
FIG. 4 shows the assembly shown in FIG. 1 in a first mode of operation with springs removed.
Figure 5:
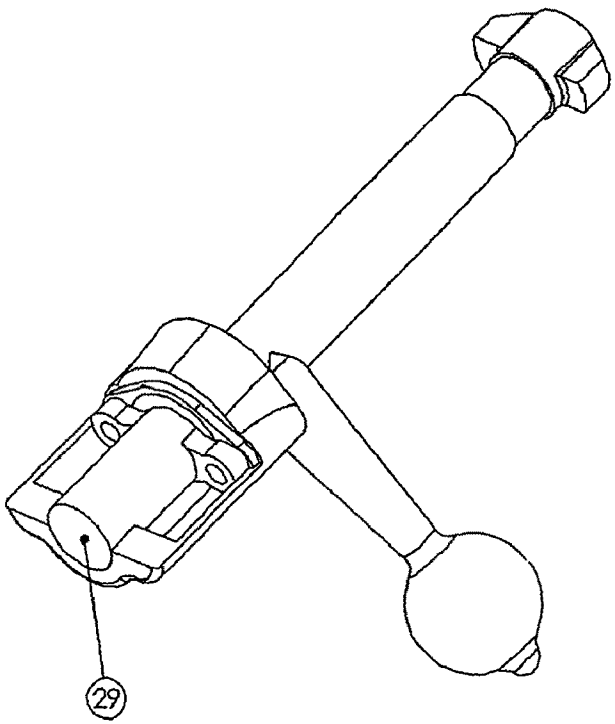
FIG. 5 shows the assembly shown in FIG. 4 in the second mode of operation.

The shroud insert 17 has a circular bore 19 therethrough configured to fit over the top of the enlarged cylindrical section 14 of bolt 12. The exterior surface is somewhat elliptical in shape with left and right side lobes 20, 21 provided with axially aligned holes 22, 23. As shown in FIG. 3 the shroud insert 17 sits at the rear end of housing 18. The striker or cocking piece 16 is generally a cylindrical rod which has lateral lobes 24, 25 each having a respective axial hole 26, 27 aligned with respective holes 22, 23 of the shroud insert 17. The housing 18 has an appropriately shaped central channel to snugly seat the striker 16. The housing 18 may also provide specially configured left and right side channels to seat the left and right side lobes 24, 25 and associated springs. The shape of the channels can be configured to suit the design of the striker 16.

The opening to the channel 28 at the proximal end of the housing 18 allows the proximal end of the striker to protrude therethrough. The length of the striker is designed so that the distal end 30 is able to be pushed into contact with the firing pin which protrudes through the firing pin hole 15. Springs (not shown) are typically provided between the proximal faces of the lobes 24 and 25 and the opposing inner faces of the housing 18. Axial pins extend on the left and right hand sides of the assembly 11 between openings 22 and 26 and 23 and 27 respectively. These pins help align the striker 16 with the opposing face at the base end of the bolt 12. When assembled the striker 16 is seated in the housing 18 with the left and right side springs compressed so that the rear end of the striker protrudes as far as it can beyond the rear end of the housing 18. At the opposite end of the housing 18 the shroud insert 17 is located over the enlarged cylindrical section 14 of bolt 12 like a sleeve and is seated at the front end of the housing 18. A cap or upper component can be located over the lower part of the housing 18 to fully house the striker 16, springs and shroud insert 17.

Figure 6:
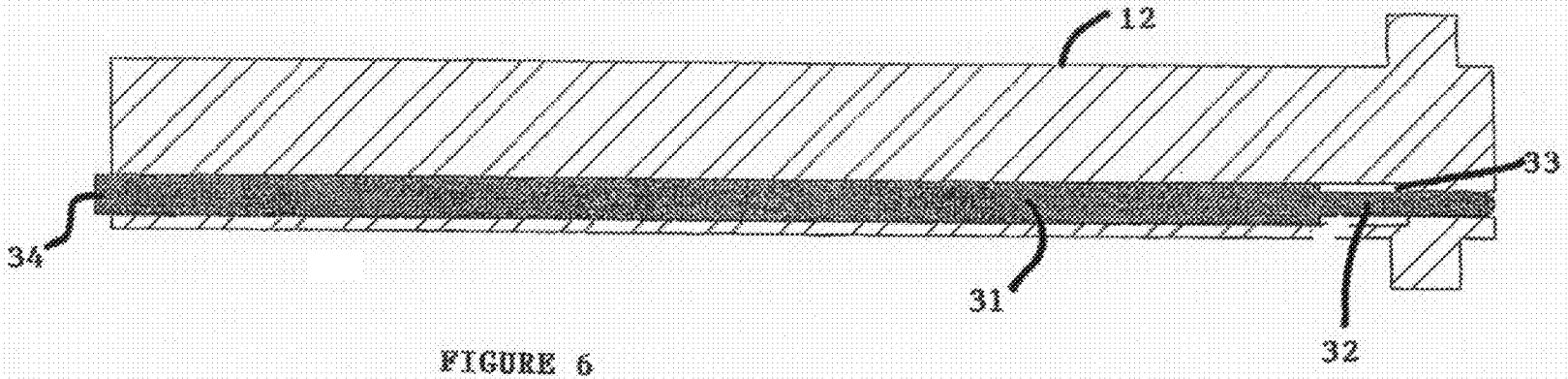
FIG. 6 is a cross-sectional side view of a bolt and firing pin in accordance with a preferred embodiment of the invention.

As shown in FIG. 6, firing pin 31 is a thin long cylindrical piece of metal 31 with a section of reduced diameter 32 at its front end which is configured to strike the back of a cartridge. In addition, the front section 32 is surrounded by a small return spring 33. This ensures that the firing pin 31 is returned to its ready for firing position with its rear end 34 protruding slightly beyond the flat face of the bolt 12.

Because of the reduced cross-sectional diameter of the front section 32 beyond the spring 33, the diameter of the central bore 35 extending through the bolt 12 steps down into a smaller passage large enough to house the reduced diameter of the front section 32.

The whole striker assembly would typically be located in part of a specially designed receiver assembly so that the rear end of the striker is able to be activated by a firing mechanism.

The striker assembly 11 and bolt 12 are able to axially slide to enable cartridge loading and discharge. As shown in FIG. 2 the striker 16 may be provided with a sear 31 to allow for cocking of the striker. The cocking action may be provided using an outer sleeve having a window with a cam surface which is able to abut against the sear 31.

In an alternative embodiment the opposing faces of the rear end 13 of the bolt 12 and the front end of the striker 16 may be provided with pin(s) and a co acting cam surface in order to provide for cocking of the striker assembly.

In operation when the striker 16 is fully cocked ready for firing, both springs are fully compressed. Activation of the firing mechanism results in release of the sear 27 and movement of the striker 16 towards the firing pin under the force of the expanding springs. To reload the firearm the striker can be pushed back to its ready for firing position by using the bolt handle to slide the bolt 12 backwards. The co acting pin(s) and cam surface will at the same time move the striker 16 into the ready for firing position. The bolt 12 is able to rotate relative to the shroud insert 17 to enable reloading without forcing similar rotation of the striker assembly 11. As previously outlined the firing pin can be located for either a centre firing or rim firing action.

The design of the shroud and striker, spring and shroud insert may be changed as long as the striker is kept as a separate part from the bolt 12.

The design of the bolt in the above-described preferred embodiment allows the bolt 12 to rotate because there is only a small axial hole through it to house the firing pin. If the bolt also contained a spring and spring support for a rim fire firearm the bolt is not able to rotate because the front half of the bolt must be cut away to allow the top cartridge in a magazine to be partially aligned with the chamber.

Figure 7:
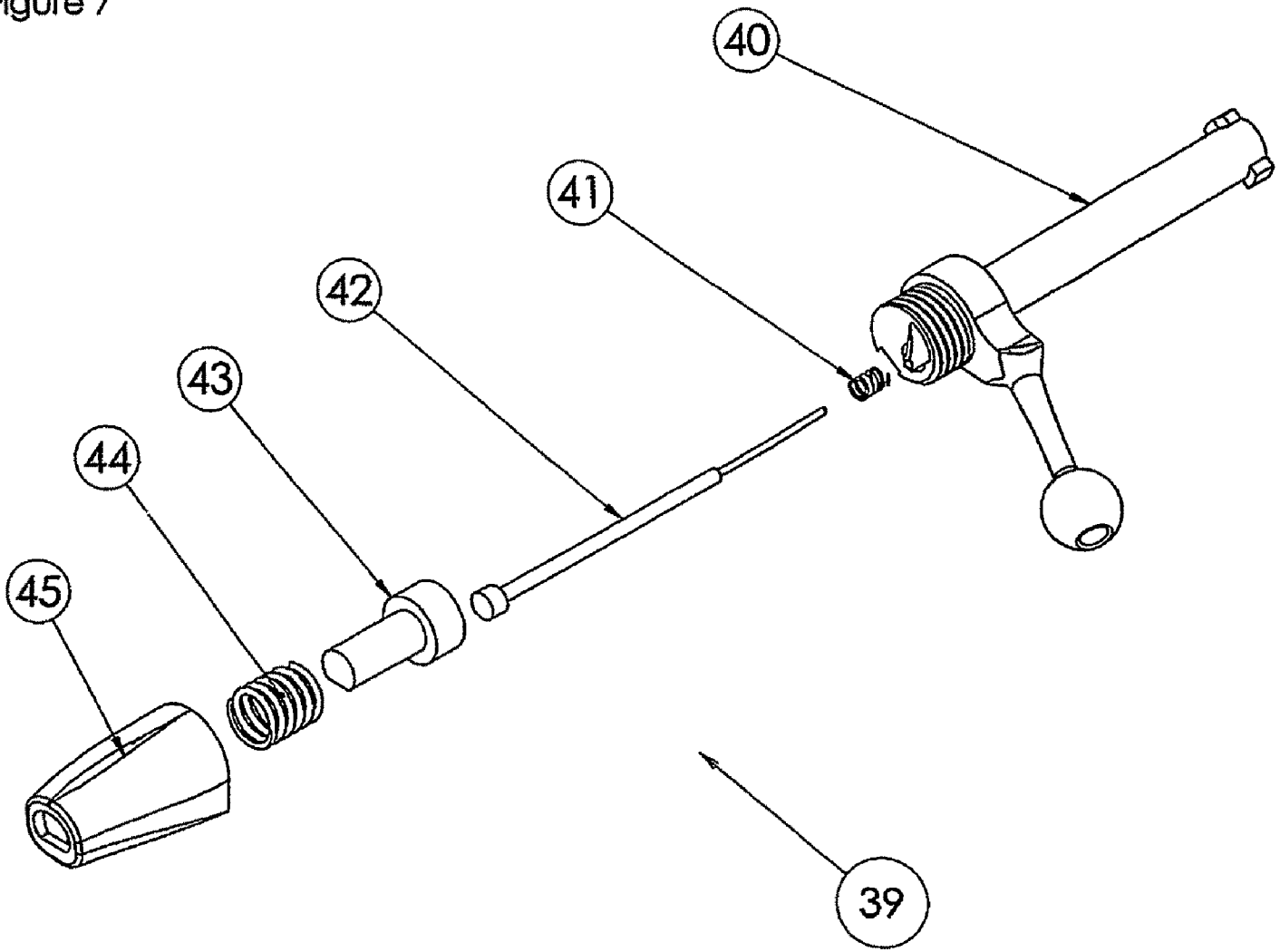
FIG. 7 shows a disassembled perspective view of a striker assembly according to another embodiment of the present invention.

Referring to FIG. 7 the striker assembly 39 shown consists of a bolt body 40, a firing pin return spring 41, a firing pin 42, a striker 43, a main spring 44 and a shroud 45.

The shape of the striker 43 is in contrast to the striker 16 shown in FIG. 2, generally a cylindrical bolt shape with a cylindrical head instead of lobes 24 and 25. The spring 44 fits over the proximal end of the striker 43 and together with the striker 43 fits within shroud 45. The shroud insert 17 is eliminated from this embodiment.

Figure 8:
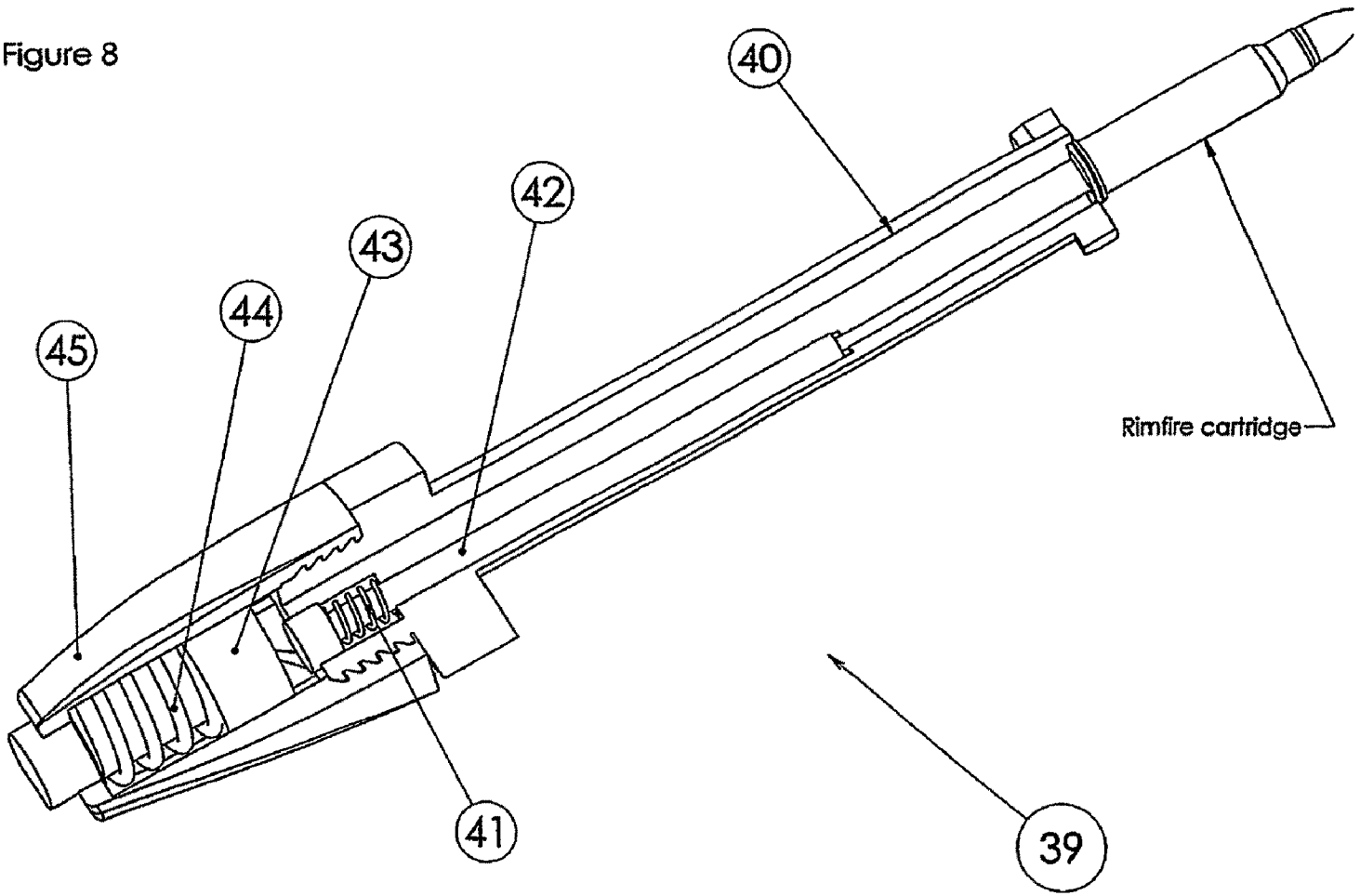
FIG. 8 shows a cross-sectional perspective view of the assembly shown in FIG. 7 with a bolt body.

As shown in FIG. 8 the striker 43 is positioned behind the bolt body 40. The bolt body 40 is provided, as more clearly shown in FIG. 7, with an offset centre axial bore (rim fire version) sized to receive the firing pin 42.

Figure 9:
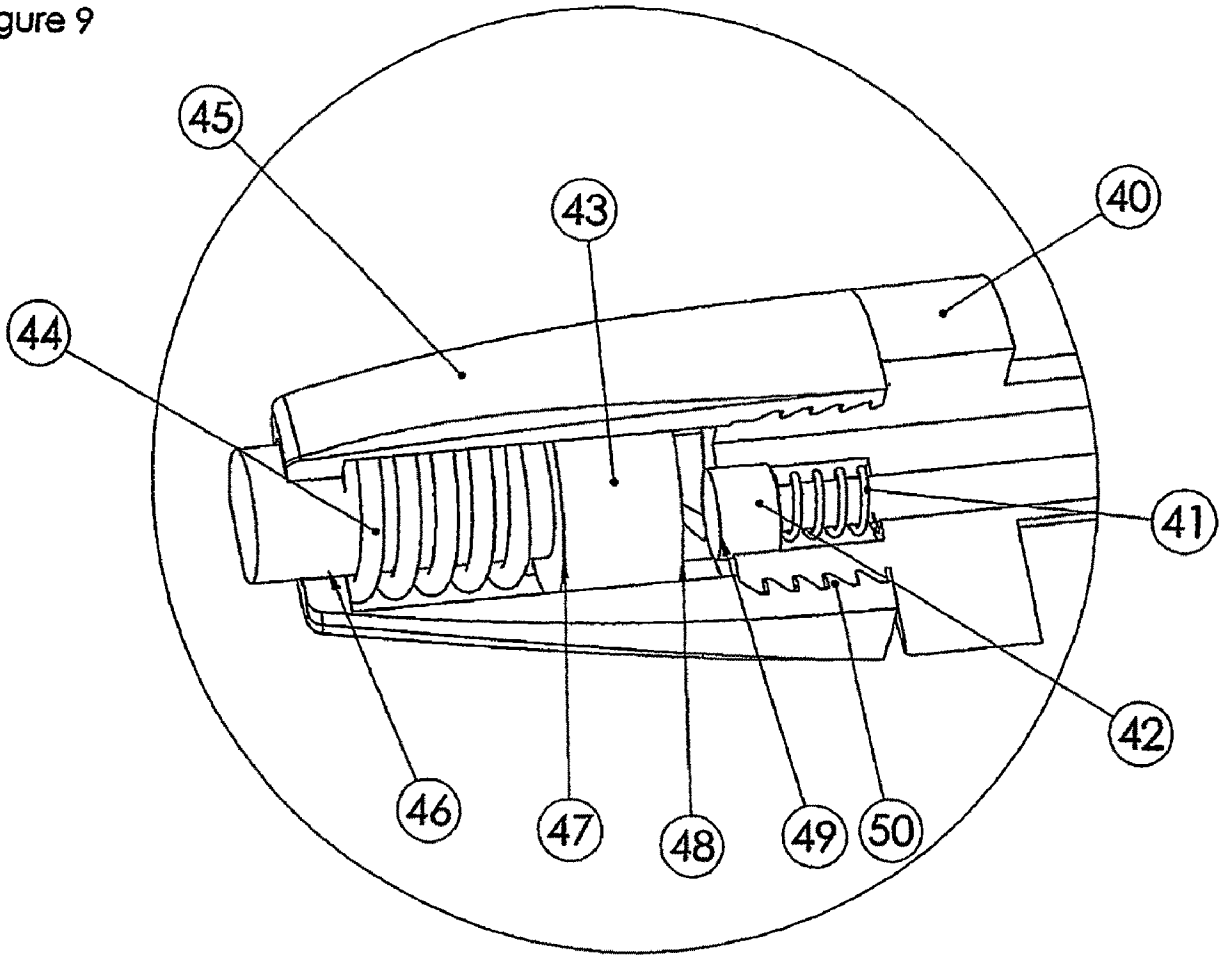
FIG. 9 shows a close-up view of the assembly shown in FIG. 8.

FIG. 9 shows a close up view of the shroud 45 attached to bolt 40. In this Figure the striker 43 is in the firing or cocked position.

As shown in FIG. 9 the proximal end of the bolt body 40 has in this case been threaded 50 to allow the shroud 45 to be attached to the bolt body 40 while still allowing the shroud 45 to rotate relative to the axis of the bolt body 40.

The striker 43 and main spring 44 are assembled within the shroud 45 such that the main spring 44 is constrained between the rear inner wall 46 of the shroud 45 and the larger diameter 46 of the striker 43.

The firing pin 42 and firing pin return spring 41 are assembled within the bolt body 40 such that the firing pin 42 has its pin head 49 protruding from the rear of the bolt body 40.

Figure 10:
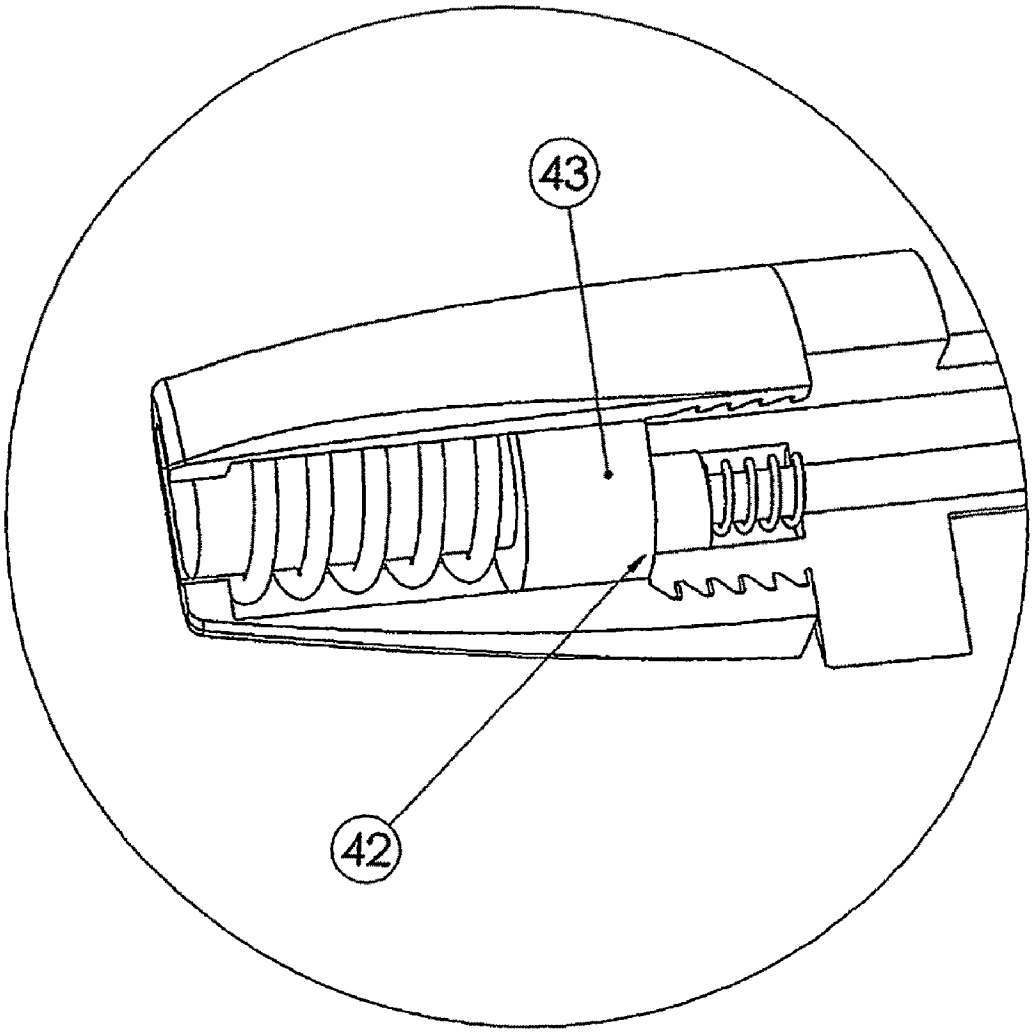
FIG. 10 shows a close-up view of the assembly shown in FIG. 8, with the striker in the fired or uncocked position.

Reference to FIG. 10 shows the striker in the fired or uncocked position. Thus it can be seen how the head of the striker 43 now contacts the head of the firing pin 42.

Figure 11:
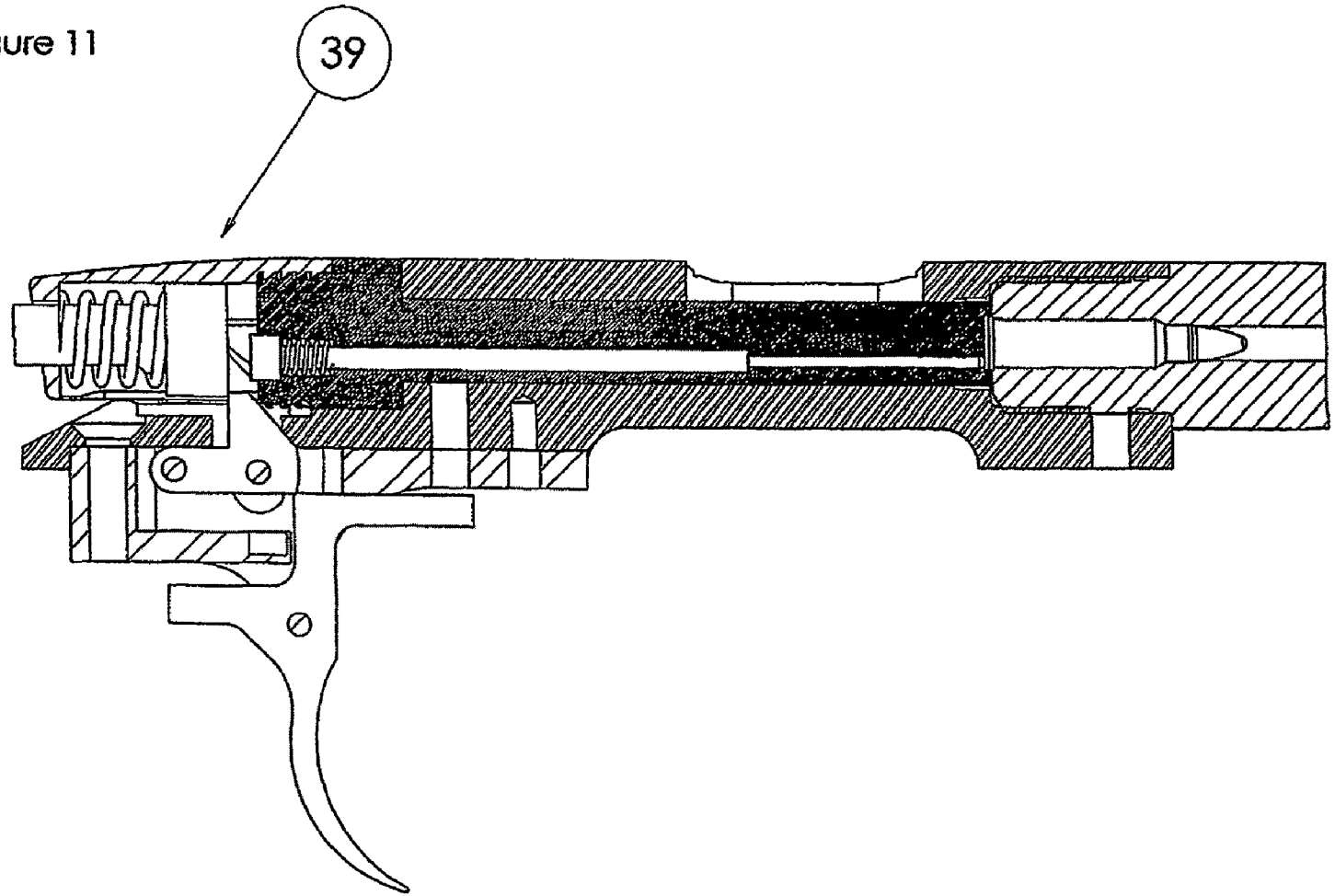
FIG. 11 shows the assembly shown in FIG. 8 assembled with a receiver assembly and sectioned to show that the striker is in a cocked or ready to fire state.

The assembly 39 shown in FIGS. 7-10 would typically be located in a receiver assembly shown in FIG. 11, so that the striker 43 is able to be released from a ready to fire or cocked position as shown in FIG. 9 and allowed to be driven by the energy stored in the main spring 44 into a fired or uncocked position as shown in FIG. 10.

Figure 12:
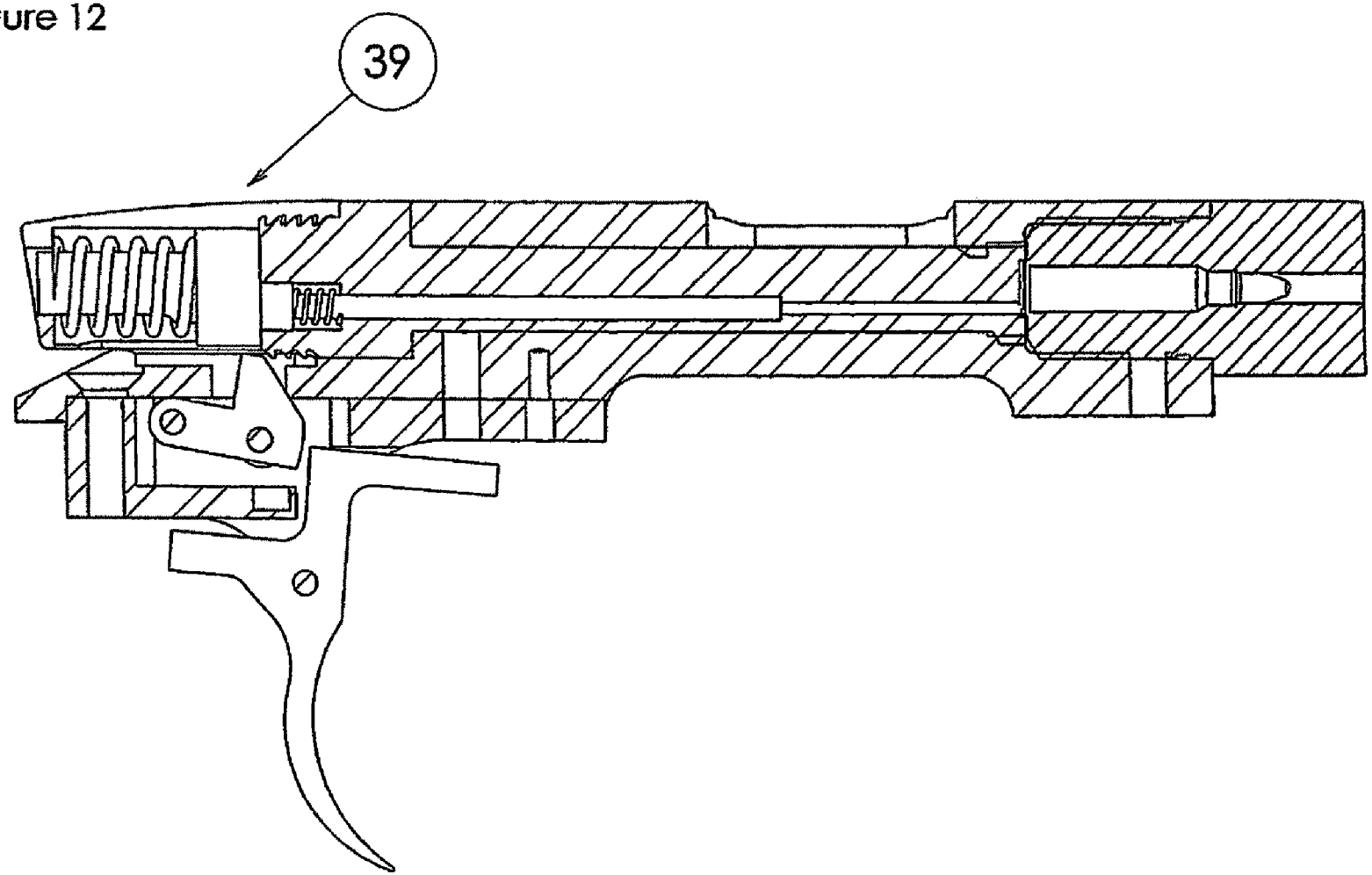
FIG. 12 shows the assembly shown in FIG. 11 sectioned to show that striker is in a fired or uncocked state.

The assembly 39 shown in FIG. 8 is able to axially slide within the receiver assembly shown in FIG. 12 to enable loading and unloading of cartridges.

When using compression spring/s as the spring means within the assembly in FIG. 9 the cocking action may be provided by a cam relationship between the bolt body 40 and the striker 43 such that when the bolt body 40 is rotated to the open position the striker 43 is forced towards the rear of the shroud 45 and thus compresses the main spring/s.

When using extension spring/s as the spring means within the assembly in FIG. 9 the cocking action may be provided by a cam relationship between the bolt body 40 and the striker 43 such that when the bolt body 40 is rotated to the open position the striker 43 is forced towards the rear of the shroud 45 and thus extends the main spring/s.

The cocking action may be provided by forcing the striker 43 to be restrained while the bolt body 40 is pushed forward into the closed position prior to moving the bolt body 40 into the locked position.

Figure 13:
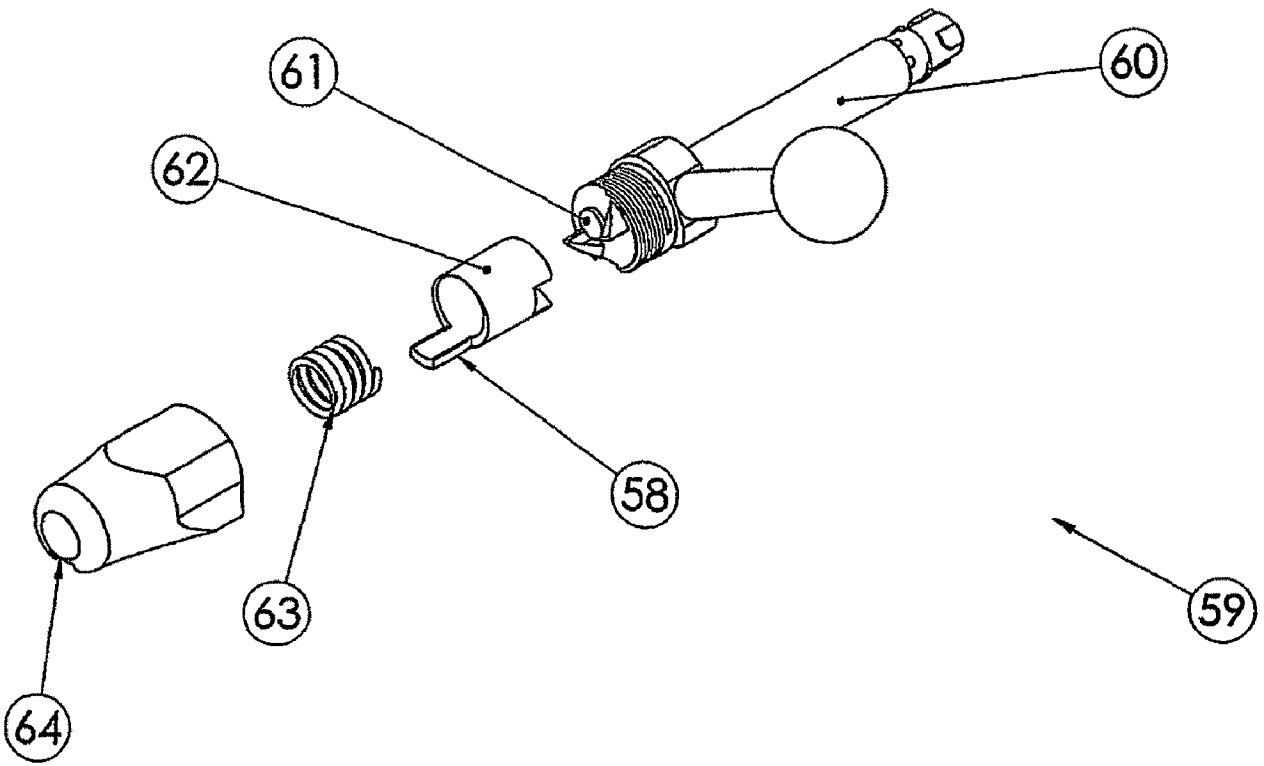
FIG. 13 shows a disassembled perspective view of a striker assembly according to a further embodiment of the present invention.

Referring to another embodiment of the invention shown in FIG. 13, a disassembled assembly 59 consists of a bolt body 60, a firing pin 61, a striker 62, a main spring 63 and a shroud 64.

Figure 14:
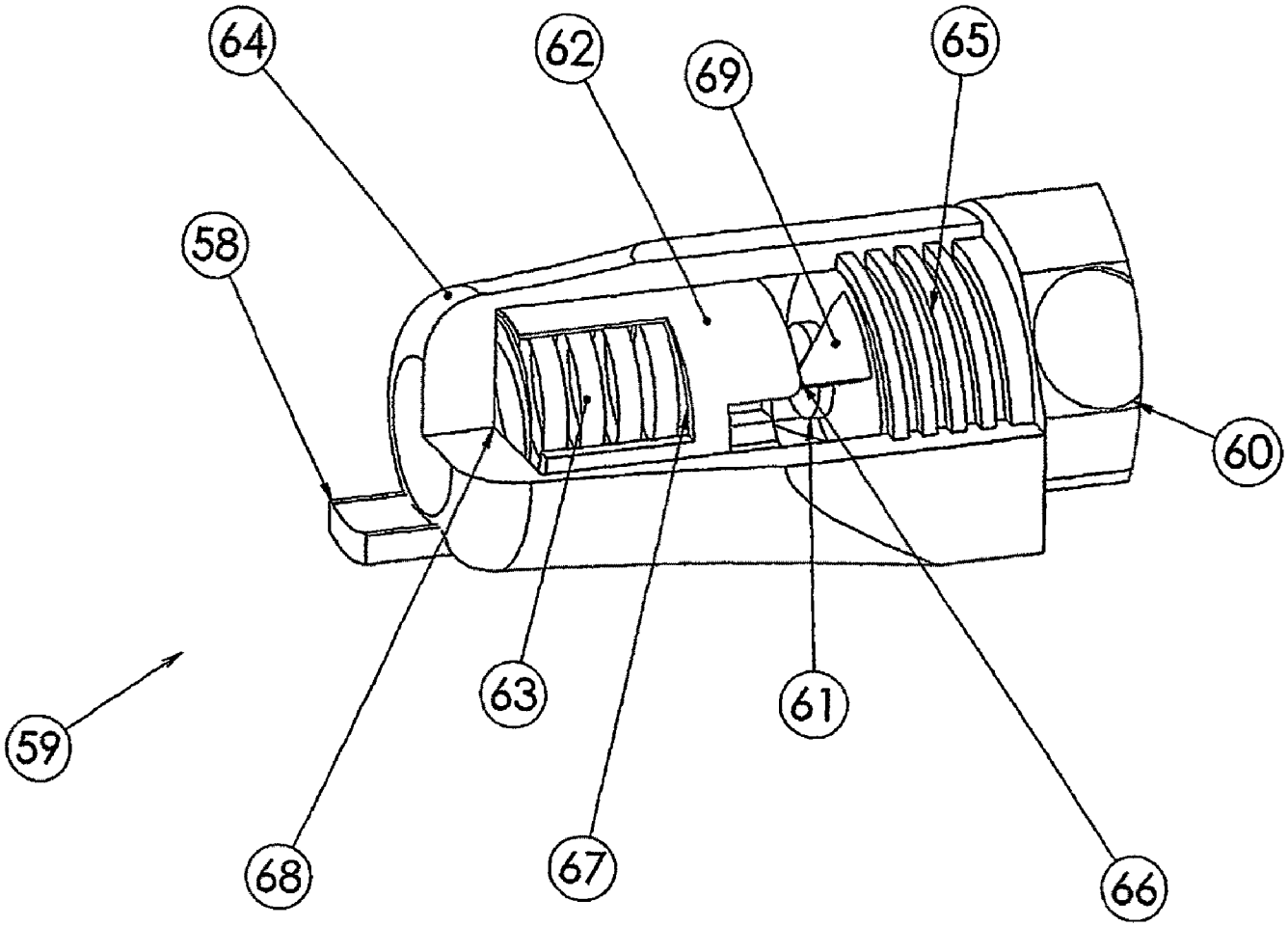
FIG. 14 shows a close-up view of the assembly shown in FIG. 13.

In this embodiment the striker 62 is in the form of a tubular structure with a lower leg portion 58 extending axially from a proximal edge thereof. Additional legs may be provided around the periphery of the striker 62 as shown in FIG. 14. Spring 63 is then able to be held in the space provided within the confines of the legs 58.

Referring to FIG. 14 which shows a close up of the assembly 59 shown in FIG. 13, the striker 62 is shown in the cocked position.

As shown in FIG. 14 the striker 62 is positioned behind the bolt body 60. The bolt is provided, as more clearly shown in FIG. 13, with an off centre axial bore (rim fire version) sized to receive a firing pin 61.

As shown in FIG. 14 the proximal end of the bolt body 60 has in this case been threaded 65 to allow the shroud 64 to be attached to the bolt body 60 while still allowing the shroud 64 to rotate relative to the axis of the bolt body 60.

The striker 62 and main spring 63 are assembled within the shroud 64 such that the main spring 63 is constrained between the rear inner wall 68 of the shroud 64 and a counter bored face (67) of the striker 62.

The firing pin 61 is assembled within the bolt body 60 such that the firing pin 61 protrudes from the rear of the bolt body 60.

The bolt body 60 has been provided with a protrusion 69 which in this case has been used as a cam to force the striker 62 to compress the main spring 63 against the rear inner wall 68 of the shroud 64. In this state the striker 62 has been prevented by the edge 66 of the protrusion 69 from striking the firing pin 61 until the bolt body 60 has been rotated into a position that does not impede the travel of the striker 62. This position would then be considered the locked position when the bolt body 60 has been closed on a firing chamber.

Figure 15:
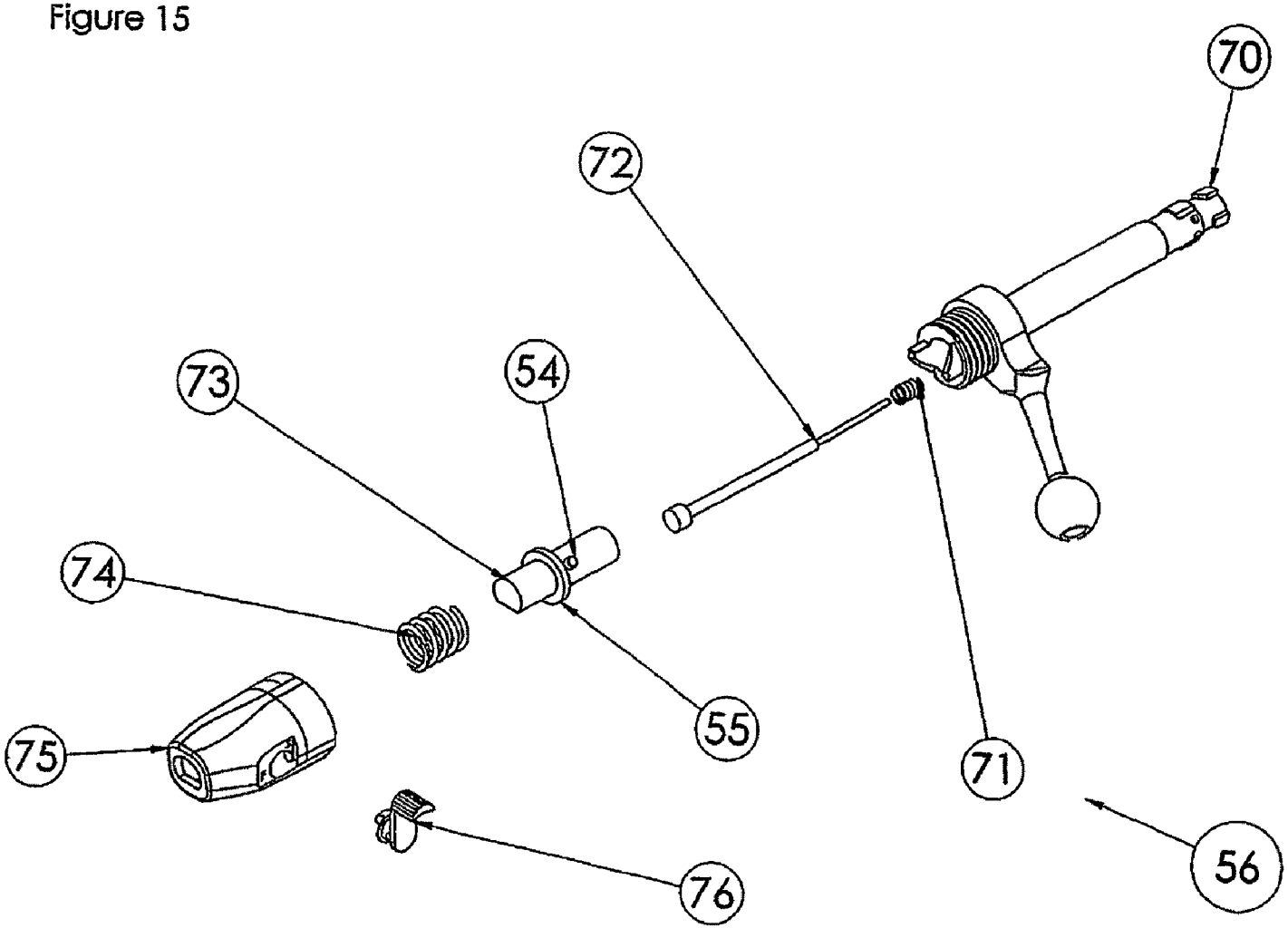
FIG. 15 shows a disassembled view of a striker assembly according to an additional embodiment of the present invention.

According to another embodiment of the present invention shown in FIGS. 15 to 19, an assembly 56 shown in FIG. 15 consists of a bolt body 70, a firing pin return spring 71, a firing pin 72, a striker 73, a main spring 74, a safety catch 76 and a shroud 75.

In this embodiment the striker 73 has a different configuration to those strikers of previous embodiments. In contrast the striker 73 is essentially a cylindrical rod which has a thin collar or ring 55 at a position slightly closer to the proximal end than the distal end thereof. A peripheral pin 54 is located on the distal side of the collar 55 and extends from the periphery thereof.

Figure 16:
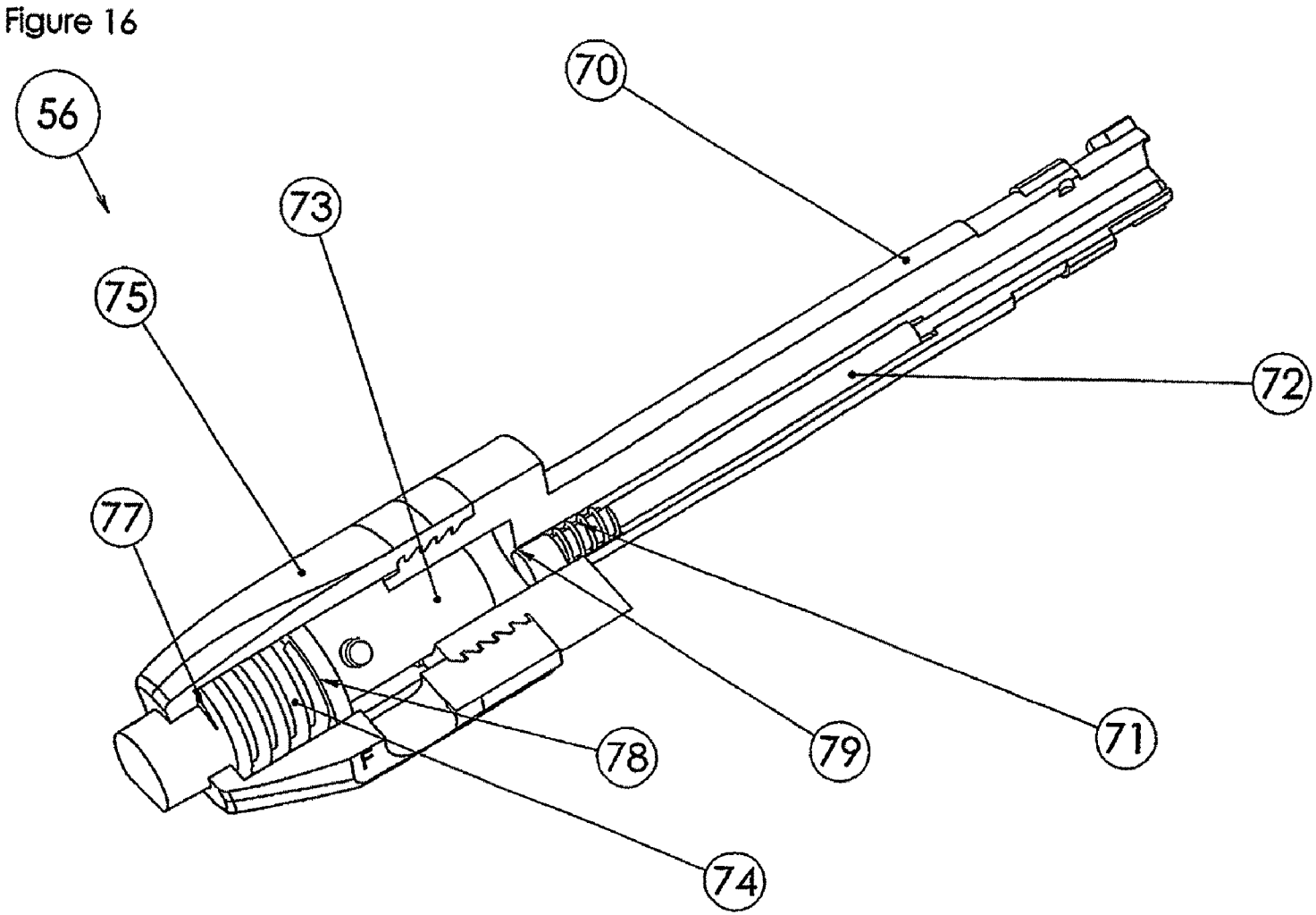
FIG. 16 shows a perspective cross-sectional view of the assembly shown in FIG. 15 when assembled with a bolt body.

As shown in FIG. 16 the striker 73 is positioned behind the bolt body 70. The bolt body 70 is provided with a central axial bore sized to receive the forward portion of the striker 73. In this case the striker 73 has been forced to compress the main spring 74 between the rear wall 77 of the shroud 75 and the rear face 78 of a flanged portion of the striker 73. The head 79 of firing pin 72 protrudes from the front wall of the central bore of the bolt body 70.

Figure 17:
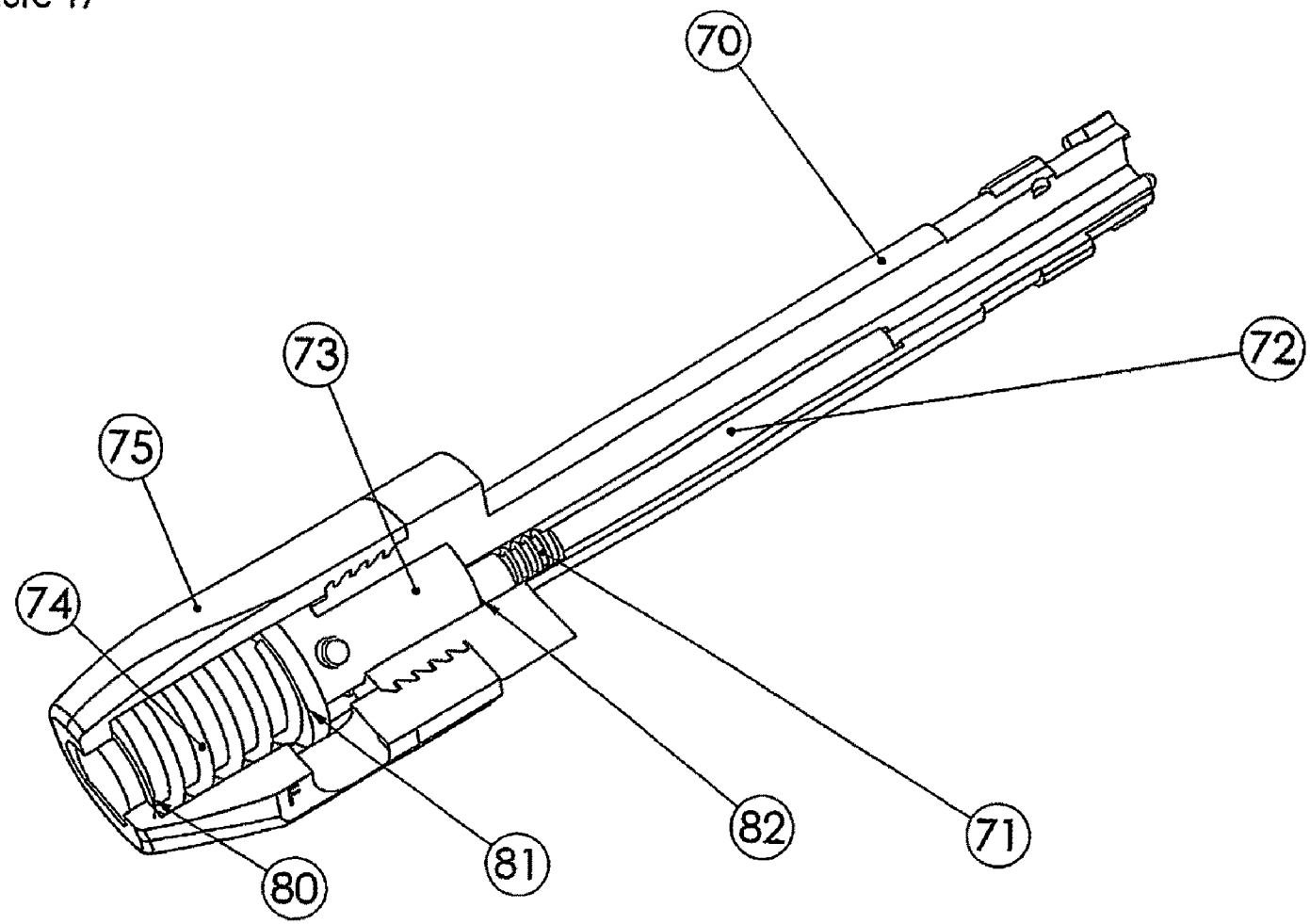
FIG. 17 shows the assembly shown in FIG. 16 with the striker in the firing or cocked position.

As shown in FIG. 17 the striker 73 is positioned behind the bolt body 70. In this case the striker 73 has been forced by the stored energy in the main spring 74 to impact upon the front wall of the central bore of the bolt body 70 thus impacting upon the firing pin 72.

Figure 18:
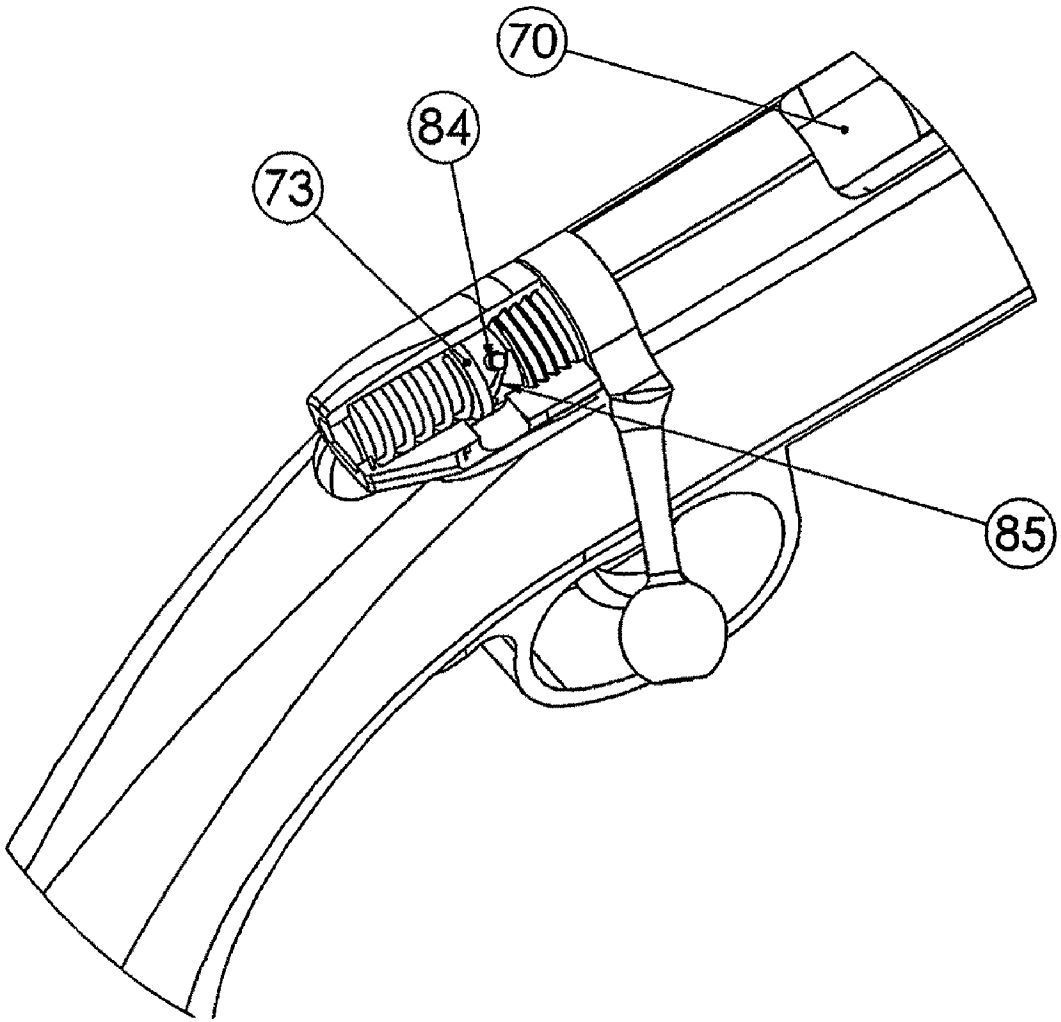
FIG. 18 shows the assembly shown in FIG. 16 assembled with a receiver assembly and stock in the fired or uncocked position.

As shown in FIG. 18 the bolt body 70 is in a position such that the cam face 85 is in contact with a pin 84 that has been provided on the striker 73.

Figure 19:
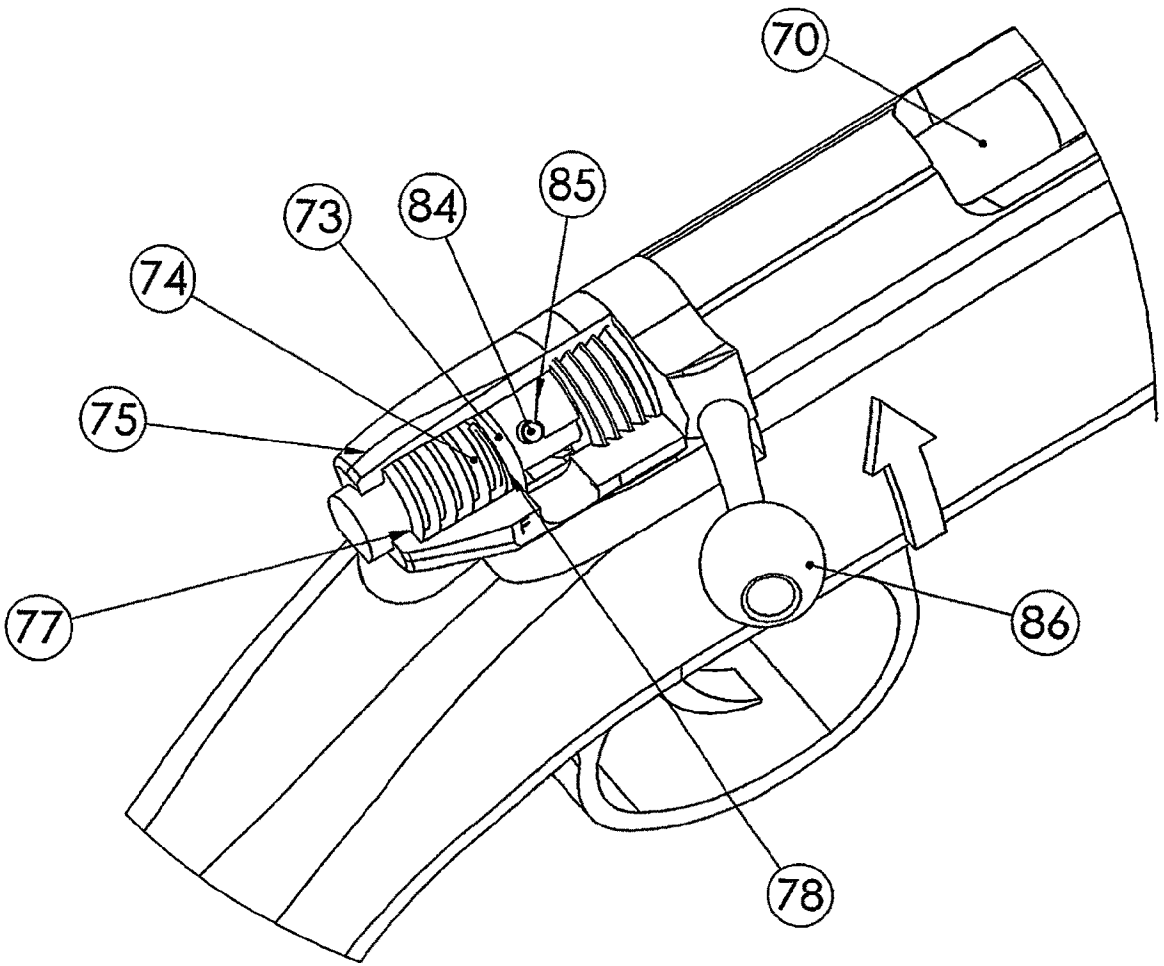
FIG. 19 shows the assembly shown in FIG. 16 assembled with a receiver assembly and stock when the bolt body has been rotated into the unlocked position.

FIG. 19 shows that by turning a bolt handle 86 the bolt body 70 will rotate and allow the cam surface 85 to act upon the lateral pin 84 and thus force the main spring 74 to be compressed between the rear wall 77 of the shroud 75 and the rear face 78 of a flanged portion of the striker 73.

According to other embodiments of the invention the rear or root end of the bolt will be threaded but not fixed into the shroud insert which in turn will be pinned or screwed to the housing.

It is to be understood that, if any prior art publication is referred to herein, such reference does not constitute an admission that the publication forms a part of the common general knowledge in the art, in Australia or in any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An assembly for a bolt action firearm, comprising:

a firing pin;

a rotatable bolt comprising a bolt main body and a handle portion attached to the bolt main body so that in use the bolt main body and handle portion move, both rotationally and longitudinally, as a unit, the bolt main body having a through bore offset from a central axis of the bolt main body, so that the bolt main body is able to receive the firing pin therethrough, offset from said central axis of the bolt main body;

an impact member for impacting on the firing pin;

at least one spring; and a housing for housing the impact member and said at least one spring;

wherein the impact member and said at least one spring are configured to be located in the housing behind a proximal end of the rotatable bolt and the impact member is able to be controlled by a firing mechanism to strike a proximal end of the firing pin when in a firing mode by release of energy stored in said at least one spring, and wherein the firing pin proximal end protrudes from the proximal end of the bolt when in the firing mode.

2. The assembly as claimed in claim 1, comprising an inner surface to coaxially align the impact member and the bolt main body.

3. The assembly as claimed in claim 1, wherein the housing includes a detachable shroud located over the proximal end of the bolt.

4. The assembly as claimed in claim 1, wherein the bolt proximal end comprises an enlarged portion having a greater diameter than a more distal portion of the main body of the bolt.

5. The assembly as claimed in claim 4, wherein the enlarged portion comprises a substantially cylindrical collar.

6. The assembly as claimed in claim 1, wherein the housing comprises a shroud including a guide which permits sliding movement of the impact member.

7. The assembly as claimed in claim 1, wherein the impact member includes a retainer for retaining said at least one spring.

8. The assembly as claimed claim 7, wherein the retainer comprises a collar.

9. The assembly as claimed in claim 7, wherein the impact member comprises an elongate main body of smaller width than the retainer.

10. The assembly as claimed in claim 1, wherein the impact member is provided with a rearwardly extending main body and said at least one spring comprises a central spring configured to fit over the main body of the impact member.

11. The assembly as claimed in claim 1, wherein the impact member is provided with a hole and said at least one spring is adapted to fit at least partially within the hole of the impact member.

12. The assembly as claimed in claim 1, wherein the housing comprises a seat for the impact member and said at least one spring.

13. The assembly as claimed in claim 1, wherein the impact member comprises a cocking piece.

14. The assembly as claimed in claim 1, wherein the impact member includes a lateral pin configured to be contacted by a cam surface to compress said at least one spring against a proximal inner wall of the housing.

* * * * *